US008061072B1

(12) United States Patent
Crose

(10) Patent No.: US 8,061,072 B1
(45) Date of Patent: Nov. 22, 2011

(54) RETRACTABLE STOCK FIREARM SYSTEM

(76) Inventor: Dinora M. Crose, Clearwater, FL (US)

( * ) Notice: Subject to any disclaimer, the term of this patent is extended or adjusted under 35 U.S.C. 154(b) by 295 days.

(21) Appl. No.: 12/381,731

(22) Filed: Mar. 16, 2009

(51) Int. Cl.
*F41C 23/14* (2006.01)

(52) U.S. Cl. ..... 42/73; 42/71.01

(58) Field of Classification Search ..... 42/72–74, 42/71.01, 94
See application file for complete search history.

(56) References Cited

U.S. PATENT DOCUMENTS

| | | | | | |
|---|---|---|---|---|---|
| 2,424,194 | A | * | 7/1947 | Sampson et al. | 42/72 |
| 2,466,017 | A | * | 4/1949 | Farber | 42/72 |
| 2,869,410 | A | * | 1/1959 | Prichard | 81/177.2 |
| 3,137,958 | A | * | 6/1964 | Lewis et al. | 42/73 |
| 3,570,162 | A | * | 3/1971 | Suddarth et al. | 42/72 |
| 3,651,736 | A | * | 3/1972 | Ingram | 42/72 |
| 3,703,046 | A | * | 11/1972 | Barone et al. | 42/94 |
| 3,811,455 | A | * | 5/1974 | Thur | 135/25.4 |
| 4,271,623 | A | * | 6/1981 | Beretta | 42/72 |
| 4,383,384 | A | * | 5/1983 | Fox | 42/72 |
| 4,581,958 | A | * | 4/1986 | Shull | 81/177.2 |
| 4,735,007 | A | * | 4/1988 | Gal | 42/72 |
| H486 | H | * | 7/1988 | Savioli | 42/73 |
| 4,844,390 | A | * | 7/1989 | Duke | 42/94 |
| 5,345,706 | A | * | 9/1994 | Brown | 42/94 |
| 5,367,812 | A | * | 11/1994 | Lautrec | 42/74 |
| 5,387,048 | A | * | 2/1995 | Kuo | 403/109.3 |
| 5,400,472 | A | * | 3/1995 | Chang | 16/113.1 |
| 5,410,833 | A | * | 5/1995 | Paterson | 42/73 |
| 5,438,786 | A | * | 8/1995 | Hilderbrand | 42/94 |
| 5,593,239 | A | * | 1/1997 | Sallee | 403/109.3 |
| 6,481,142 | B1 | * | 11/2002 | McCarthy | 42/74 |
| 6,481,143 | B2 | * | 11/2002 | McCarthy | 42/74 |
| 6,560,911 | B2 | * | 5/2003 | Sharp | 42/73 |
| 6,564,492 | B2 | * | 5/2003 | Weldle et al. | 42/74 |
| 6,763,627 | B1 | * | 7/2004 | Kaempe | 42/94 |
| 6,839,998 | B1 | * | 1/2005 | Armstrong | 42/71.01 |
| 7,418,797 | B1 | * | 9/2008 | Crose | 42/74 |
| 7,428,794 | B2 | * | 9/2008 | Oz | 42/73 |
| 7,793,453 | B1 | * | 9/2010 | Sewell et al. | 42/73 |
| 7,810,270 | B2 | * | 10/2010 | Fitzpatrick et al. | 42/73 |
| 2002/0053156 | A1 | * | 5/2002 | McCarthy | 42/74 |
| 2008/0028662 | A1 | * | 2/2008 | Abraham et al. | 42/73 |
| 2008/0236017 | A1 | * | 10/2008 | Fitzpatrick et al. | 42/73 |
| 2011/0041377 | A1 | * | 2/2011 | Thomas et al. | 42/120 |

FOREIGN PATENT DOCUMENTS

| | | | |
|---|---|---|---|
| DE | 3130562 | A1 * | 2/1983 |
| DE | 3743092 | A1 * | 7/1988 |

* cited by examiner

*Primary Examiner* — Michael Carone
*Assistant Examiner* — Jonathan C Weber

(57) ABSTRACT

A main body portion has forward and rearward extents. A conversion assembly has laterally spaced rails. Recesses formed in the rearward extent adjustably receive the rails. A stock is secured to the rails. A cheek piece has first and second surfaces. Shift components allow for the moving of the cheek piece between first and second positions. The cheek piece is positionable above and in contact with the rails when in the second position.

4 Claims, 5 Drawing Sheets

FIG 1
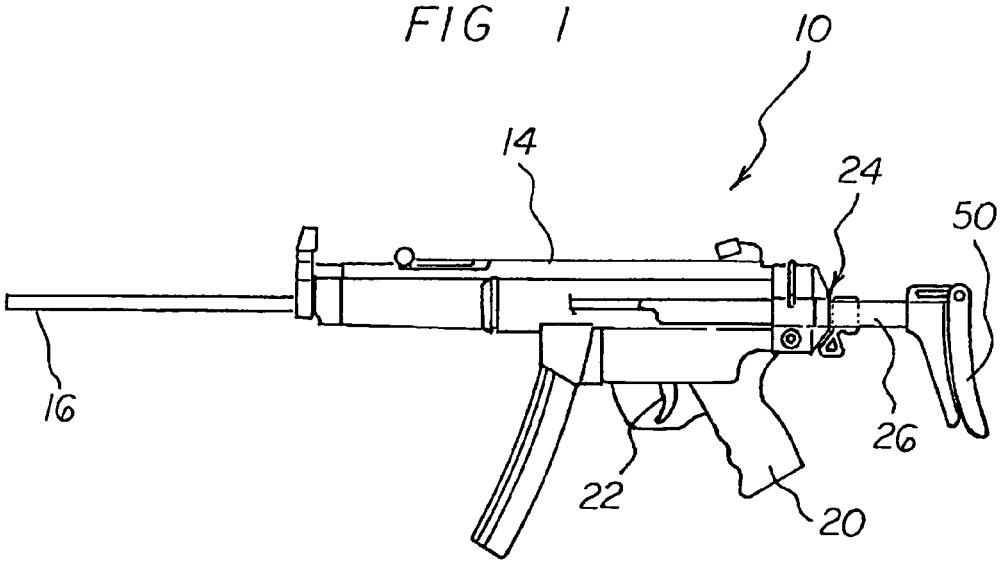
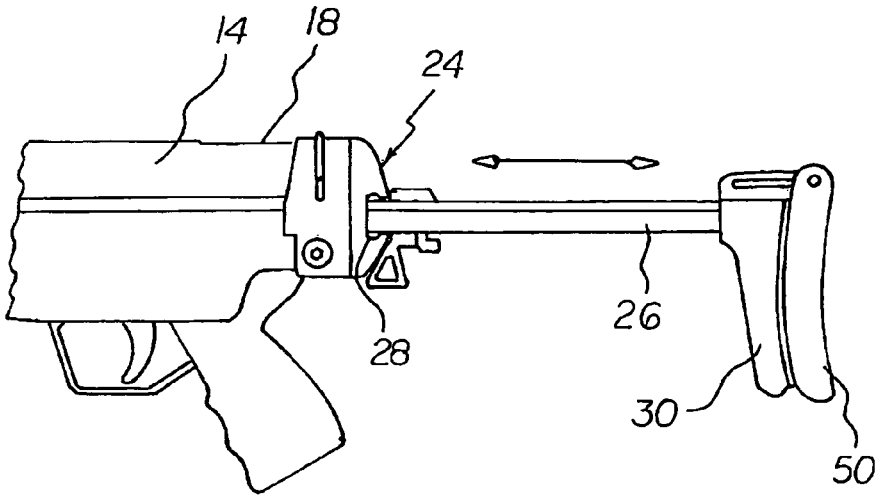
FIG 2

FIG 3
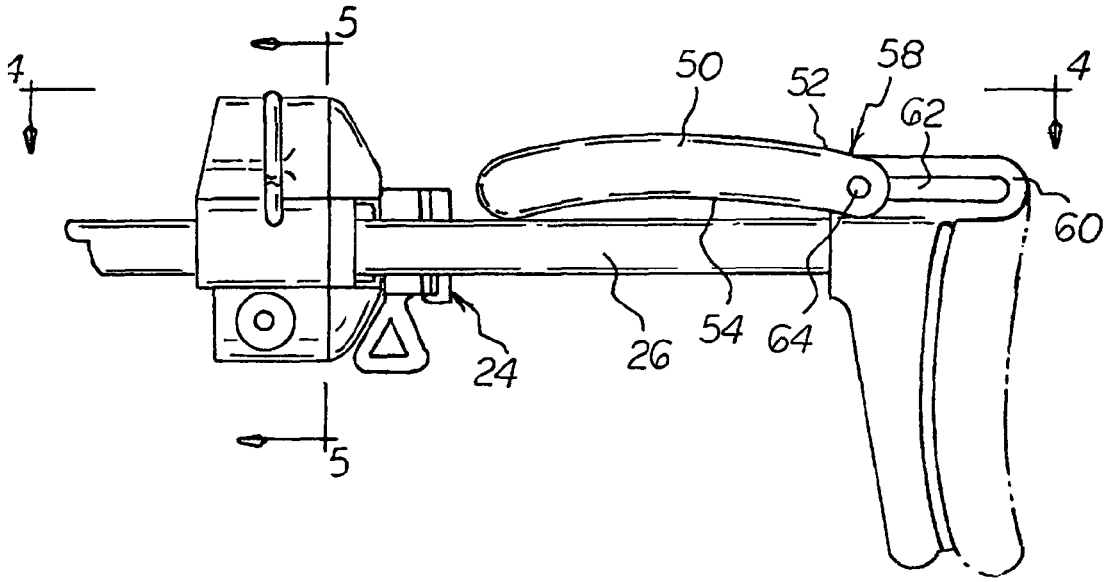
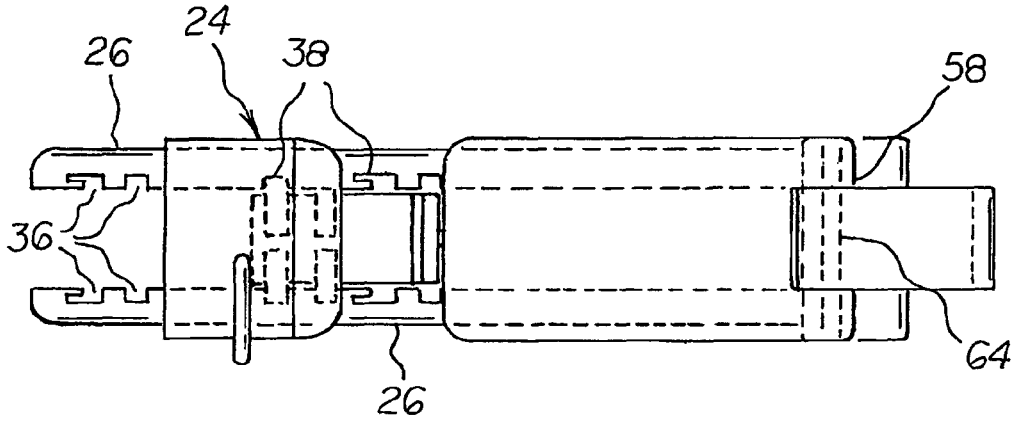
FIG 4

FIG 5
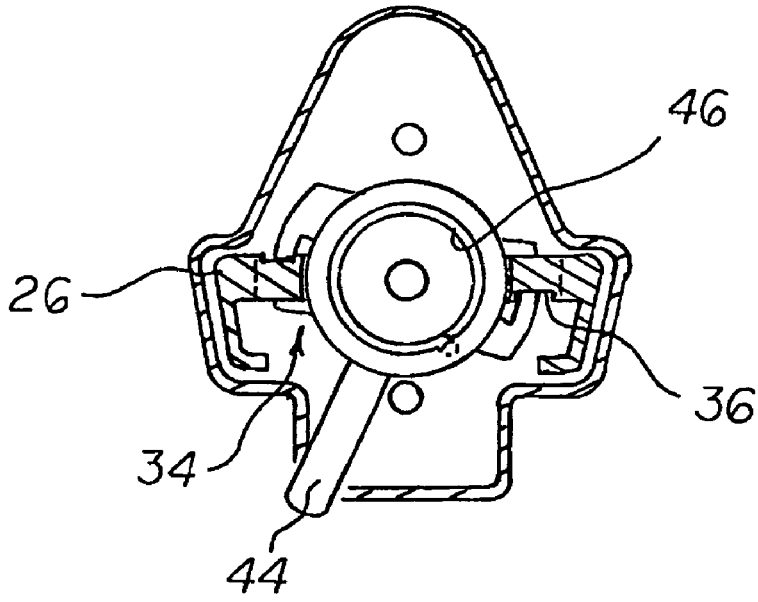
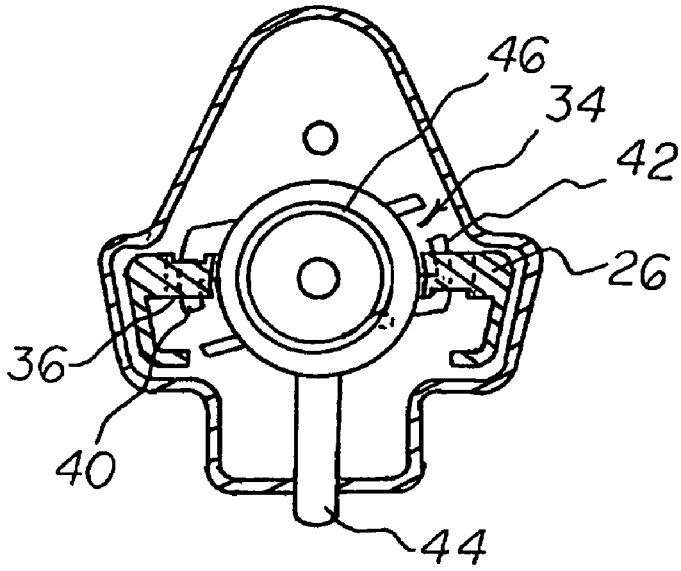
FIG 6

FIG 11
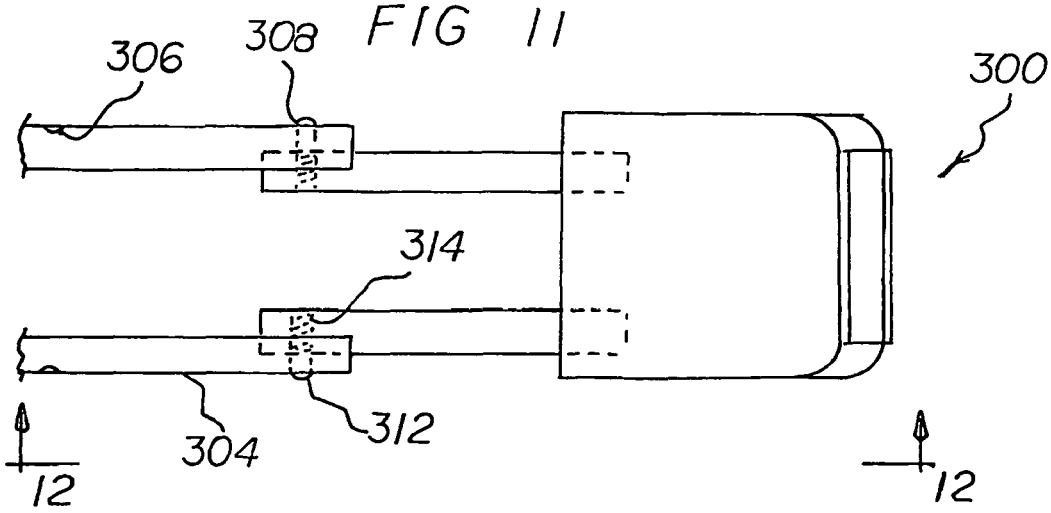
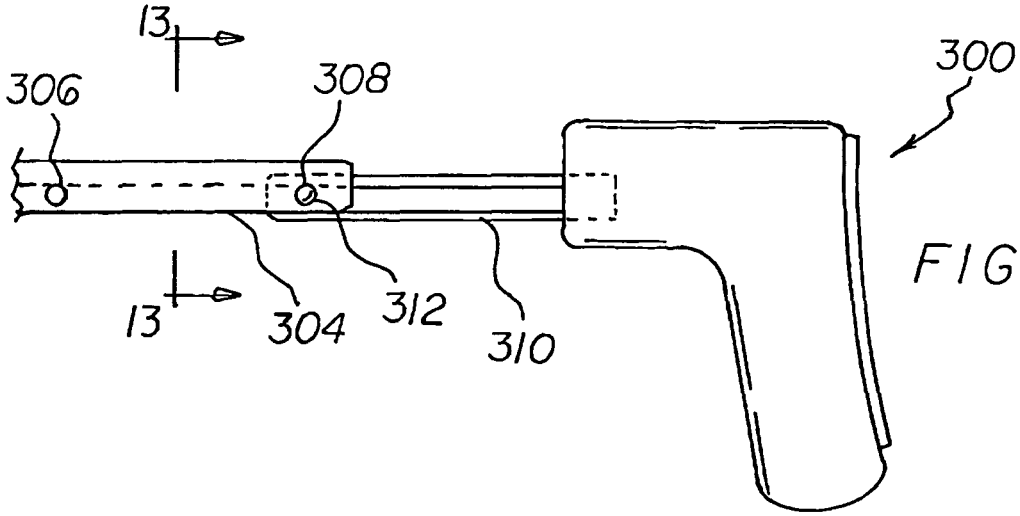
FIG 12
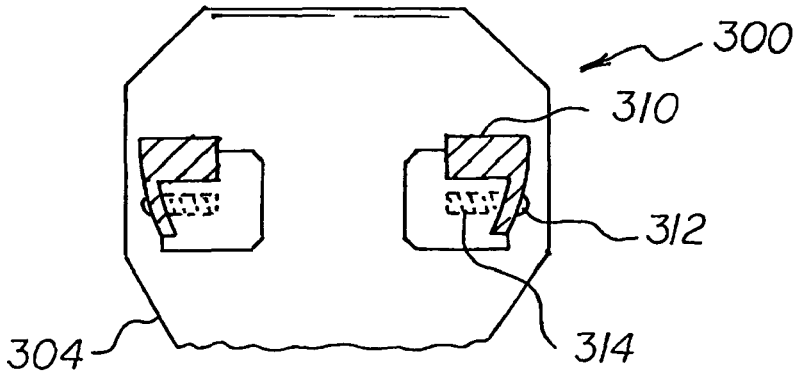
FIG 13

RETRACTABLE STOCK FIREARM SYSTEM

BACKGROUND OF THE INVENTION

Field of the Invention

The present invention relates to a retractable stock firearm system and more particularly pertains to converting a firearm between a retracted orientation for use as a hand held pistol and an extended orientation as a shoulder supported rifle with a cheek rest, the reconfiguring being done in a safe, convenient and economical manner.

SUMMARY OF THE INVENTION

In view of the foregoing disadvantages inherent in the known types of firearm systems of known designs and configurations now present in the prior art, the present invention provides an improved retractable stock firearm system. As such, the general purpose of the present invention, which will be described subsequently in greater detail, is to provide a new and improved retractable stock firearm system and method which has all the advantages of the prior art and none of the disadvantages.

To attain this, the present invention essentially comprises a retractable stock firearm system. First provided is a main body portion. The main body portion has a forward extent. In this manner bullets may be discharged. The main body portion has a rearward extent. The rearward extent includes a handle. The rearward extent also includes a trigger. The rearward extent further includes a conversion assembly.

The conversion assembly has laterally spaced rails. The conversion assembly has recesses. The recesses are formed in the rearward extent of the main body portion. In this manner the rails may be adjustably received. The conversion assembly has a stock. The stock is secured to the rails. The stock is adapted to be repositioned as the system is reconfigured between retracted and extended orientations. The stock has a concave exterior surface. In this manner a shoulder of an operator during use as a rifle may be received.

A locking assembly is provided. The locking assembly includes exterior notches. The exterior notches are provided in the rails remote from the stock. The locking assembly has interior notches. The interior notches are provided in the rails between the exterior notches and the stock. The locking assembly also has locking fingers. The fingers are adapted to oscillate between a locked position and an unlocked position. In the locked position the fingers within the notches preclude the sliding of the rails. In the unlocked position the fingers withdrawn from the notches allow sliding of the rails. The locking assembly also includes an operator controlled lever. In this manner the fingers may oscillate between the locked and unlocked positions. The locking assembly further includes a coil spring. In this manner the fingers are urged to the locked position.

Further provided is a cheek piece. The cheek piece has a pivotable end and a free end. The cheek piece is shiftable between a lowered configuration and a raised configuration. The cheek piece has a convex surface. The convex surface is positionable against the stock when in the lowered configuration. The cheek piece also has a concave surface. The concave surface is positionable above and in contact with the rails when in the raised configuration. In this manner the convex surface is adapted to receive the cheek of a user during use.

Provided last are shift components. The shift components include side plates. The side plates are secured to the stock. The side plates have lateral slots. The lateral slots are horizontally oriented above the rails. The slots have forward ends. The forward ends are provided above the stock. The slots have rearward ends. The rearward ends are provided rearwardly of the stock. The shift components also include a pin. The pin has a central portion. The central portion of the pin is secured to the pivotable end of the cheek piece. The pin has end portions. The end portions of the pin are slidably and rotatably received in the slots. The movement of the pin in the slot allowing the shifting of the cheek piece between the lowered and raised configurations.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved retractable stock firearm system which has all of the advantages of the prior art firearm systems of known designs and configurations and none of the disadvantages.

It is another object of the present invention to provide a new and improved retractable stock firearm system which may be easily and efficiently manufactured and marketed.

It is further object of the present invention to provide a new and improved retractable stock firearm system which is of durable and reliable constructions.

An even further object of the present invention is to provide a new and improved retractable stock firearm system which is susceptible of a low cost of manufacture with regard to both materials and labor, and which accordingly is then susceptible of low prices of sale to the consuming public, thereby making such retractable stock firearm system economically available to the buying public.

Even still another object of the present invention is to provide a retractable stock firearm system for converting a firearm between a retracted orientation for use as a hand held pistol and an extended orientation as a shoulder supported rifle with a cheek rest, the reconfiguring being done in a safe, convenient and economical manner.

Lastly, it is an object of the present invention to provide a new and improved retractable stock firearm system. A main body portion has forward and rearward extents. A conversion assembly has laterally spaced rails. Recesses formed in the rearward extent adjustably receive the rails. A stock is secured to the rails. A cheek piece has first and second surfaces. Shift components allow for the moving of the cheek piece between first and second positions. The cheek piece is positionable above and in contact with the rails when in the second position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a retractable stock firearm system constructed in accordance with the principles of the present invention.

FIG. 2 is an enlarged side elevational view of the system shown in FIG. 1 but with the stock in a retracted orientation.

FIG. 3 is a further enlarged side elevational view of the system shown in FIG. 2 but with the cheek piece raised.

FIG. 4 is a plan view of a portion of the system taken along line 4-4 of FIG. 3.

FIG. 5 is a cross sectional view taken along line 5-5 of FIG. 3 with the side bars unlocked for axial movement.

FIG. 6 is a cross sectional view taken along line 5-5 of FIG. 3 with the side bars locked against axial movement.

FIG. 11 is a plan view of a final alternate embodiment of the invention.

FIG. 12 is a side elevational view taken along line 12-12 of FIG. 11.

FIG. 13 is a cross sectional view taken along line 13-13 of FIG. 12.

The same reference numerals refer to the same parts throughout the various Figures.

DESCRIPTION OF THE PREFERRED EMBODIMENT

Figure 7:
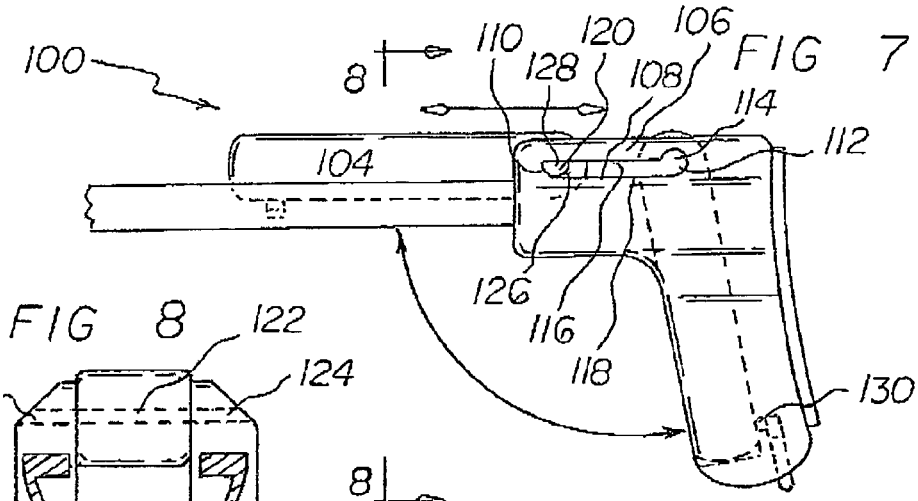
FIG. 7 is a side elevational view of an alternate embodiment of the invention.

With reference now to the drawings, and in particular to FIG. 1 thereof, the preferred embodiment of the new and improved retractable stock firearm system embodying the principles and concepts of the present invention and generally designated by the reference numeral 10 will be described.

The present invention, the retractable stock firearm system 10 is comprised of a plurality of components. Such components in their broadest context include a main body portion, a cheek piece and shift components. Such components are individually configured and correlated with respect to each other so as to attain the desired objective.

First provided is a main body portion 14. The main body portion has a forward extent 16. In this manner bullets may be discharged. The main body portion has a rearward extent 18. The rearward extent includes a handle 20. The rearward extent also includes a trigger 22. The rearward extent further includes a conversion assembly 24.

The conversion assembly has laterally spaced rails 26. The conversion assembly has recesses 28. The recesses are formed in the rearward extent of the main body portion. In this manner the rails may be adjustably received. The conversion assembly has a stock 30. The stock is secured to the rails. The stock is adapted to be repositioned as the system is reconfigured between retracted and extended orientations. The stock has a concave exterior surface. In this manner a shoulder of an operator during use as a rifle may be received.

A locking assembly 34 is provided. The locking assembly includes exterior notches 36. The exterior notches are provided in the rails remote from the stock. The locking assembly has interior notches 38. The interior notches are provided in the rails between the exterior notches and the stock. The locking assembly also has locking fingers 40, 42. The fingers are adapted to oscillate between a locked position and an unlocked position. In the locked position the fingers within the notches preclude the sliding of the rails. In the unlocked position the fingers withdrawn from the notches allow sliding of the rails. The locking assembly also includes an operator controlled lever 44. In this manner the fingers may oscillate between the locked and unlocked positions. The locking assembly further includes a coil spring 46. In this manner the fingers are urged to the locked position.

Further provided is a cheek piece 50. The cheek piece has a pivotable end and a free end. The cheek piece is shiftable between a lowered configuration and a raised configuration. The cheek piece has a convex surface 52. The convex surface is positionable against the stock when in the lowered configuration. The cheek piece also has a concave surface 54. The concave surface is positionable above and in contact with the rails when in the raised configuration. In this manner the convex surface is adapted to receive the cheek of a user during use.

Provided last are shift components 58. The shift components include side plates 60. The side plates are secured to the stock. The side plates have lateral slots 62. The lateral slots are horizontally oriented above the rails. The slots have forward ends. The forward ends are provided above the stock. The slots have rearward ends. The rearward ends are provided rearwardly of the stock. The shift components also include a pin 64. The pin has a central portion. The central portion of the pin is secured to the pivotable end of the cheek piece. The pin has end portions. The end portions of the pin are slidably and rotatably received in the slots. The movement of the pin in the slot allowing the shifting of the cheek piece between the lowered and raised configurations.

Figure 8:
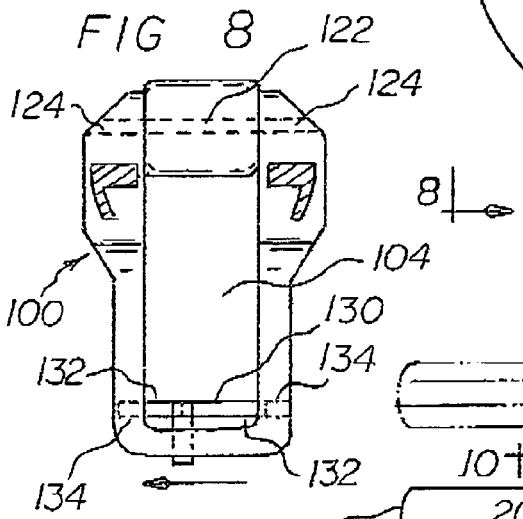
FIG. 8 is a cross sectional view taken along line 8-8 of FIG. 7.

Reference is now made to the first alternate embodiment 100 as illustrated in FIGS. 7 and 8. A cheek piece 104 is provided. The cheek piece has pivotable and free ends. The shift components include side plates 106. The side plates are secured to the stock. The side plates have lateral slots 108. The lateral slots are horizontally oriented above the rails. The slots have forward ends 110. The forward ends are provided above the stock. The slots have rearward ends 112. The rearward ends are provided rearwardly of the stock. The slots have a generally circular configuration 114 of a fixed diameter at the rearward ends. The slots have parallel upper and lower edges 116, 118 for the majority of their extents. Spacing is provided between the edges. The spacing is equal to half the fixed diameter. The shift components also include a pin 120. The pin has a central portion 122. The central portion of the pin is secured to the pivotable end of the cheek piece. The pin has end portions 124. The end portions of the pin are slidably and rotatably received in the slots. The end portions have cross sections. The pin has a semi-cylindrical lower region 126. In this manner the rearward ends of the slots may be rotated. The end portions have flat upper regions 128. In this manner the pin may slide along the upper edges of the rails. The movement of the pin in the slot allows the moving of the cheek piece between the lowered and raised configurations.

The system further includes a lock 130. The lock is provided on the free end of the cheek piece. The lock has ends 132. The he stock has indents 134. In this manner the ends are received. Also in this manner the cheek piece is locked when an end is in an indent. Further in this manner the cheek piece is unlocked when an end is not in an indent.

Figure 9:
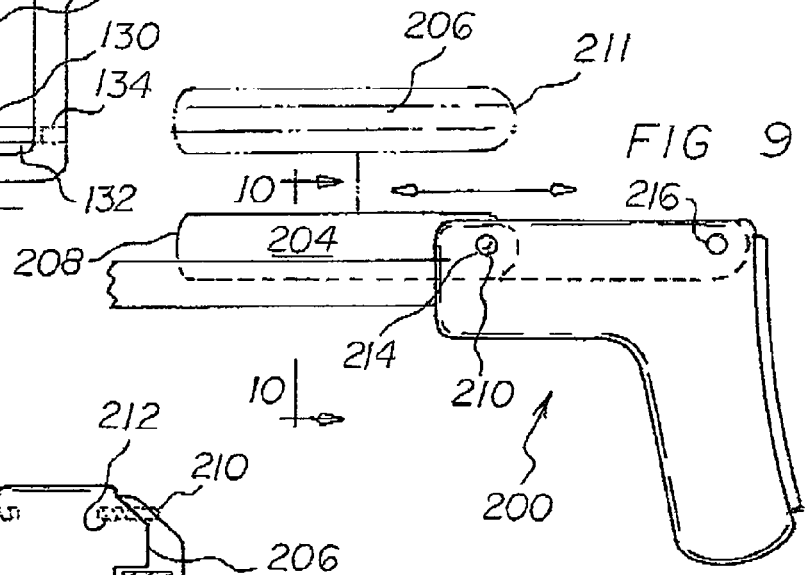
FIG. 9 is a side elevational view of another alternate embodiment of the invention.
Figure 10:
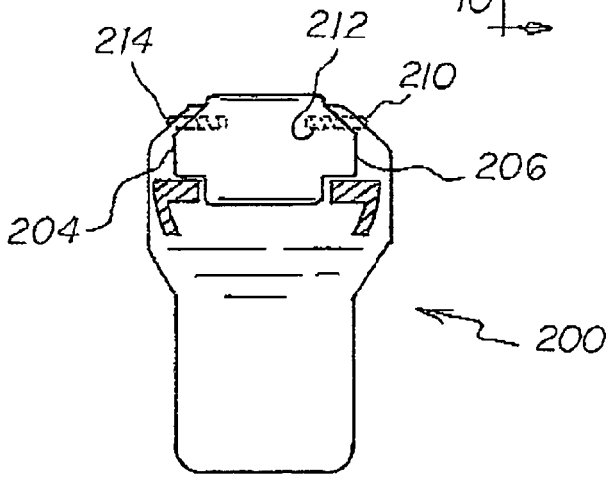
FIG. 10 is a cross sectional view taken along line 10-10 of FIG. 9.

Reference is now made to the second alternate embodiment 200 as illustrated in FIGS. 9 and 10. A cheek piece 204 is provided. The cheek piece has side faces 206. Each side face has a forward end 208 and a rearward end 211. The cheek piece has locking balls 210. The cheek piece has coil springs 212. In this manner the locking balls are urged outwardly. The locking balls and coil springs are in the side faces of the cheek piece adjacent to the rearward end. The stock has a forward aperture 214. The stock has a rearward aperture 216. In this manner when the locking balls are removably received in the forward apertures the cheek piece is in an operative orientation above the rails. Further in this manner when the locking balls are removably received in the rearward apertures the cheek piece is in an inoperative orientation rearwardly of the rails.

Reference is now made to the final alternate embodiment 300 as illustrated in FIGS. 11, 12 and 13. Each of the rails has a forward part 304. The forward part is removably received in the main body portion. Each forward part has laterally spaced front apertures 306. Each forward part has back apertures 308. Each of the rails has a rearward part 310. A locking ball 312 is provided. A coil spring 314 is provided. The coil spring urges the locking ball outwardly. In this manner when the locking balls are removably received in the front apertures the rails are extended. Further in this manner when the locking balls are removably received in the rear apertures the rails are contracted.

In this final embodiment, the handle is adapted to have a hollow section as in the embodiments of FIGS. 7, 8, 9 and 10 for the removable receipt of forwardly extending components such as the cheek plats or the extenders.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retractable stock firearm system comprising:

a main body portion having a forward extent and a rearward extent, a conversion assembly having laterally spaced rails, recesses formed in the rearward extent for adjustably receiving the rails, a stock secured to the rails;

a cheek piece movable between a first and a second position, the cheek piece having a first surface and a second surface, the cheek piece being positionable above and in contact with the rails when in the second position; and shift components for allowing the moving of the cheek piece between the first and second positions, wherein the cheek piece has a pivotable end and a free end and the shift components include side plates secured to the stock with lateral slots horizontally oriented above the rails, the slots having forward ends above the stock and rearward ends rearwardly of the stock, the shift components also including a pin with a central portion secured to the pivotable end of the cheek piece, the pin having end portions slidably and rotatably received in the slots, the movement of the pin in the slot allowing the shifting of the cheek piece between the first and second positions.

2. A retractable stock firearm system comprising:

a main body portion having a forward extent and a rearward extent, a conversion assembly having laterally spaced rails, recesses formed in the rearward extent for adjustably receiving the rails, a stock secured to the rails;

a cheek piece movable between a first and a second position, the cheek piece waving a first surface and a second surface, the cheek piece being positionable above and in contact with the rails when in the second position; and shift components for allowing the moving of the cheek piece between the first and second positions wherein the cheek piece has pivotable and free ends and wherein the shift components include side plates secured to the stock and having lateral slots horizontally oriented above the rails, the slots having forward ends above the stock and rearward ends rearwardly of the stock, the slots having a generally circular configuration of a fixed diameter at the rearward ends, the slots having parallel upper and lower edges for the majority of their extents with spacing between the edges being equal to half the fixed diameter, the shift components also including a pin with a central portion secured to the pivotable end of the cheek piece, the pin having end portions slidably and rotatably received in the slots, the end portions having cross sections with a semi-cylindrical lower region for rotating in the rearward ends of the slots, the end portions having flat upper regions 128 for sliding along the upper edges of the rails, the movement of the pin in the slot allowing the moving of the cheek piece between the lowered and raised configurations, the system further including a lock on the free end of the cheek piece, the lock having ends and the stock having indents for receiving the ends, whereby the cheek piece is locked when an end is in an indent, and whereby the cheek piece is unlocked when an end is not in an indent.

3. A retractable stock firearm system comprising:

a main body portion having a forward extent and a rearward extent, a conversion assembly having laterally spaced rails, recesses formed in the rearward extent for adjustably receiving the rails, a stock secured to the rails;

a cheek piece movable between a first and a second position, the cheek piece having a first surface and a second surface, the cheek piece being positionable above and in contact with the rails when in the second position; and shift components for allowing the moving of the cheek piece between the first and second positions wherein the cheek piece has side faces with a forward end and a rearward end, the cheek piece having locking balls with coil springs urging the locking balls outwardly, the locking balls and coil springs being in the side faces of the cheek piece adjacent to the rearward end, a forward aperture and a rearward aperture in the stock whereby when the locking balls are removably received in the forward apertures the cheek piece is in an operative orientation above the rails and whereby when the locking balls are removably received in the rearward apertures the cheek piece is in an inoperative orientation rearwardly of the rails.

4. A retractable stock firearm system for converting a firearm between a retracted orientation for use as a hand held pistol and an extended orientation as a shoulder supported rifle with a cheek rest, the system comprising, in combination:

a main body portion having a forward extent for the discharge of bullets and a rearward extent including a handle and a trigger and a conversion assembly, the conversion assembly having laterally spaced rails, recesses formed in the rearward extent of the main body portion for adjustably receiving the rails, a stock secured to the rails adapted to be repositioned as the system is reconfigured between retracted and extended orientations, the stock having a concave exterior surface for receiving a shoulder of an operator during use as a rifle;

a locking assembly including exterior notches in the rails remote from the stock and interior notches in the rails between the exterior notches and the stock, locking fingers adapted to oscillate between a locked position with the fingers within notches to preclude sliding of the rails and an unlocked position with the fingers withdrawn from the notches to allow sliding of the rails, an operator controlled lever for oscillating the fingers between the locked and unlocked positions, a coil spring urging the fingers to the locked position;

a cheek piece having a pivotable end and a free end, the cheek piece being shiftable between a lowered configuration and a raised configuration, the cheek piece having a convex surface positionable against the stock when in the lowered configuration, the cheek piece having a concave surface positionable above and in contact with the rails when in the raised configuration whereby the convex surface is adapted to receive the cheek of a user during use; and shift components including side plates secured to the stock, the side plates having lateral slots horizontally oriented above the rails, the slots having forward ends above the stock and rearward ends rearwardly of the stock, the shift components including a pin with a central portion secured to the pivotable end of the cheek piece, the pin having end portions slidably and rotatably received in the slots, the movement of the pin in the slot allowing the shifting of the cheek piece between the lowered and raised configurations.

* * * * *